US008511636B2

(12) United States Patent
Kücük et al.

(10) Patent No.: US 8,511,636 B2
(45) Date of Patent: Aug. 20, 2013

(54) HOUSEHOLD APPLIANCE

(75) Inventors: Cengiz Kücük, Syrgenstein (DE); Manfred Seeβle, Gerstetten (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 383 days.

(21) Appl. No.: 12/743,376

(22) PCT Filed: Oct. 29, 2008

(86) PCT No.: PCT/EP2008/064636

§ 371 (c)(1),
(2), (4) Date: May 18, 2010

(87) PCT Pub. No.: WO2009/068398

PCT Pub. Date: Jun. 4, 2009

(65) Prior Publication Data

US 2010/0243847 A1 Sep. 30, 2010

(30) Foreign Application Priority Data

Nov. 29, 2007 (DE) ..... 10 2007 057 512

(51) Int. Cl.

| | |
|---|---|
| ***F16M 3/00*** | (2006.01) |
| ***F16M 5/00*** | (2006.01) |
| ***F16M 7/00*** | (2006.01) |
| ***F16M 9/00*** | (2006.01) |

(52) U.S. Cl.
USPC ..... 248/677; 248/188.4; 248/188.8

(58) Field of Classification Search
USPC ..... 248/188.4, 188.8, 677, 188.9, 188.1, 248/615, 688
See application file for complete search history.

(56) References Cited

U.S. PATENT DOCUMENTS

| | | | | |
|---|---|---|---|---|
| 3,084,211 | A | 4/1963 | Rapata et al. | |
| 3,155,771 | A | 11/1964 | Steger et al. | |
| 3,325,692 | A | 6/1967 | Manetti et al. | |
| 4,624,511 | A * | 11/1986 | Oehme | 312/273 |
| 7,198,238 | B2 * | 4/2007 | Inoue | 248/188.4 |
| 2005/0116134 | A1 * | 6/2005 | Lee et al. | 248/650 |
| 2006/0103281 | A1 | 5/2006 | Cho | |
| 2007/0145229 | A1 | 6/2007 | Johnson | |

FOREIGN PATENT DOCUMENTS

| | | | |
|---|---|---|---|
| DE | 1975373 | U | 12/1967 |
| DE | 4138112 | A1 | 5/1993 |
| DE | 9116814 | U1 | 2/1994 |
| DE | 19856991 | A1 | 6/1999 |
| WO | 2004107914 | A1 | 12/2004 |

* cited by examiner

*Primary Examiner* — Amy J. Sterling
(74) *Attorney, Agent, or Firm* — James E. Howard; Andre Pallapies

(57) ABSTRACT

A household appliance, in particular a dish-rinsing or dish-washing machine, with a base support onto which the appliance unit is mounted and which is supported on a floor by means of appliance feet. In an exemplary embodiment of the invention, a least one appliance-foot support, which is connected to the base support by means of a tension element, is provided for the base support.

11 Claims, 4 Drawing Sheets

HOUSEHOLD APPLIANCE

BACKGROUND OF THE INVENTION

Household appliances generally have a base support or mounting base that supports appliance units. Inter alia the rinsing-liquid container, lye pump, and other appliance units can be mounted on the base support in the case of dishwashers. Provided additionally on the base support are the appliance feet for supporting the household appliance on the kitchen floor. The front appliance feet are therein secured in forwardly downward projecting support arms of the base support and arranged more or less underneath an appliance door to provide a secure footing for the household appliance.

Especially in the case of a large-scale serial production of differently dimensioned household appliances encompassing many variants the geometric positioning of the front appliance feet has to be effort-intensively matched to the respective appliance variant.

BRIEF SUMMARY OF THE INVENTION

The object of the present invention is to provide a household appliance, in particular a dishwasher, where the assembly effort is reduced in particular also when there are different appliance variants.

According to the characterizing portion of claim 1, the base support is assigned at least one separate appliance-foot support supporting an appliance foot. The appliance-foot support is joined to a base support via a tensioning element for simple mounting.

The appliance-foot support can project frontally from the base support in a depth direction of the appliance. Corresponding contact surfaces of the appliance-foot support and base support can in that case be in area contact. The foot spacing in the depth direction of the appliance is advantageously increased for a secure appliance footing by means of the appliance-foot support projecting forwardly from the base support.

In order in a simple manner to obtain area contacting between the above-cited contact surfaces that is free from play, the tensioning element can be a tension lever. The tension lever pushes/pulls the appliance-foot support against the base support's contact surface with a predefined tensile force.

It is very important for the appliance-foot support to have a firm tension joint free from play on the base support to insure that the household appliance will have a secure footing on the appliance feet. A statically favorable force transmission into the appliance foot will be produced if the tension lever is provided in a vertical direction below the contact surfaces of the appliance-foot support and base support. The top part of the appliance-foot support can in that way—through the creation of a tilting moment around the tensioning element's bottom mount that is free from play—be supported transversely against the base support's contact surface.

It is especially preferable for the tensioning element to be molded onto the appliance-foot support in a materially integral manner and/or as a single piece therewith. For production-engineering purposes it is therein preferable for the appliance-foot support to form a single plastic injection-molded part with the tensioning element.

The tensioning element can have an angled limb which under the effect of the tensile force is able to engage behind a backstop embodied in the base support. The tensioning element can therein be elastically stretched when the appliance-foot support is in its mounted condition for producing the tensile force. A pressure contact of said type that is free from play between the appliance-foot support and base support can contrary to the invention be established by means of a more effort-intensive screw connection.

The appliance-foot support can together with the tensioning element preferably form a U-shaped, open holding profile which as the tensile force is established can be mounted onto the base-support backstop and will engage around it. The backstop can therein be clamped or, as the case may be, fixed between a contact surface of the appliance-foot support and the tensioning element's angled limb.

For establishing the tensile force in the tensioning element the appliance-foot support can be positioned onto the base support's backstop through a tilting or swiveling motion. The tensioning element's angled limb is guided along a contact edge or surface of the backstop during said tilting motion as the tensile force is established until the tensioning element is positioned on the backstop.

For guiding the above-described tilting motion the appliance-foot support can be positioned by means of an angular segment of its U-shaped holding profile onto a facing contact edge of the backstop. The contact edge facing the appliance-foot support thus forms a static swivel axis around which the appliance-foot support is brought in a guided tilting motion to engage with the backstop.

To therein insure that the tensioning element engages securely with the backstop, a bracing element is provided by means of which an undesired departure of the tensioning element from its rest position is prevented.

The tensioning element can furthermore be assigned a snap-in connector, in particular having an elastically adjustable or, as the case may be, deflectable catch hook. The snap-in connector secures the appliance-foot support's mounting position in which the tensioning element engages around the backstop in a pretensioned manner. A snap-in/clamping connector that can be mounted/detached in a simple manner with no additional screws is produced in that way between the appliance-foot support and base part.

The snap-in connector prevents an undesired detaching motion of the appliance-foot support during which the tensioning element would cease to be engaged with the backstop. In particular a swiveling motion of the tensioning element disengaging it from the backstop will be prevented.

For a connection protected from external influences, the tensioning element and/or catch hook of the appliance-foot support can in its mounted position project into an insertion shaft of the base support. The catch hook can therein engage behind a first shaft wall of the insertion shaft. A second shaft wall opposite the first shaft wall can in a simple manner from the production-engineering viewpoint therein be provided directly by the backstop.

So that the appliance-foot support can be easily detached from the base support for customer-service purposes, the first shaft wall can have an opening to provide access for a tool. The tool can push the catch hook into an unlocking position, as a result of which it will be possible to release the appliance-foot support from its positional fixture and swivel it from its engagement with the backstop together with the tensioning element.

BRIEF DESCRIPTION OF THE DRAWINGS

An exemplary embodiment of the invention is described below with the aid of the attached figures, in which.

DETAILED DESCRIPTION OF EXEMPLARY EMBODIMENTS OF THE PRESENT INVENTION

Figure 1:
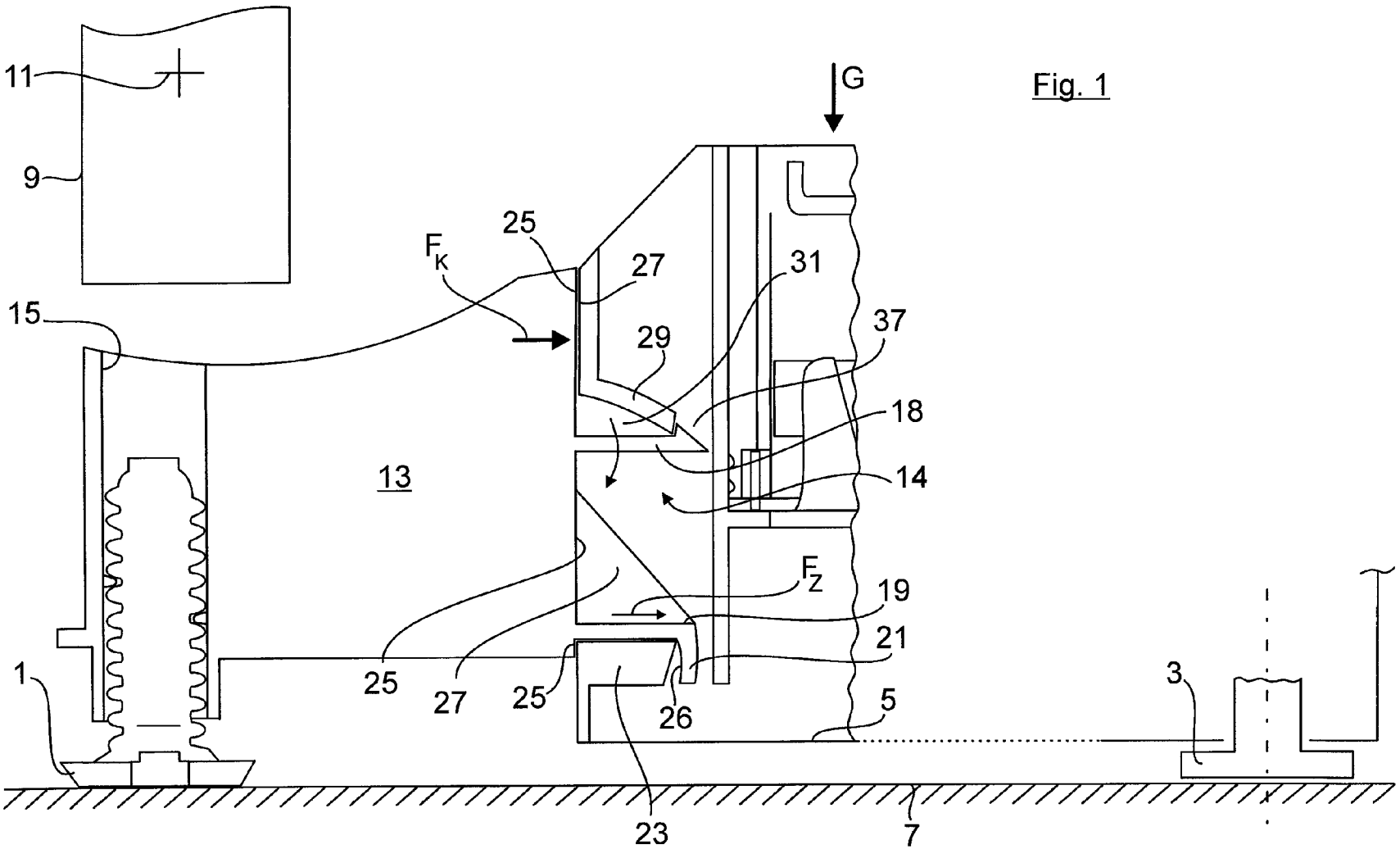
FIG. 1 is an enlarged schematic partial sectional side view of the bottom region of a household appliance supported on appliance feet.

FIG. 1 is a highly schematic sectional side view of a household appliance's base region having a front appliance foot 1 and a rear appliance foot 3. The rear appliance foot 3 projects on the base side through a base support 5. The appliance feet 1 and 3 both support the household appliance on the floor 7.

The base support 5 supports appliance units (not shown) of the household appliance. In the case of a dishwasher they can be a rinsing-liquid container and a lye pump etc. The household appliance shown in FIG. 1 additionally has a frontally located swiveling door 9 that can be moved via an indicated swivel axis 11 extending perpendicular to the plane of the drawing. Extending below the swiveling door 11 is an appliance-foot support 13. It is mounted frontally on the base support 5 via a snap-in/clamping connector 14. By means of the appliance-foot support 13, the appliance foot 1 can be supported at a frontal distance in front of the base support 5 directly below the appliance door 9 on the floor 7. A secure footing for the dishwasher will be insured thereby also when the appliance door 9 is open.

Figure 2:
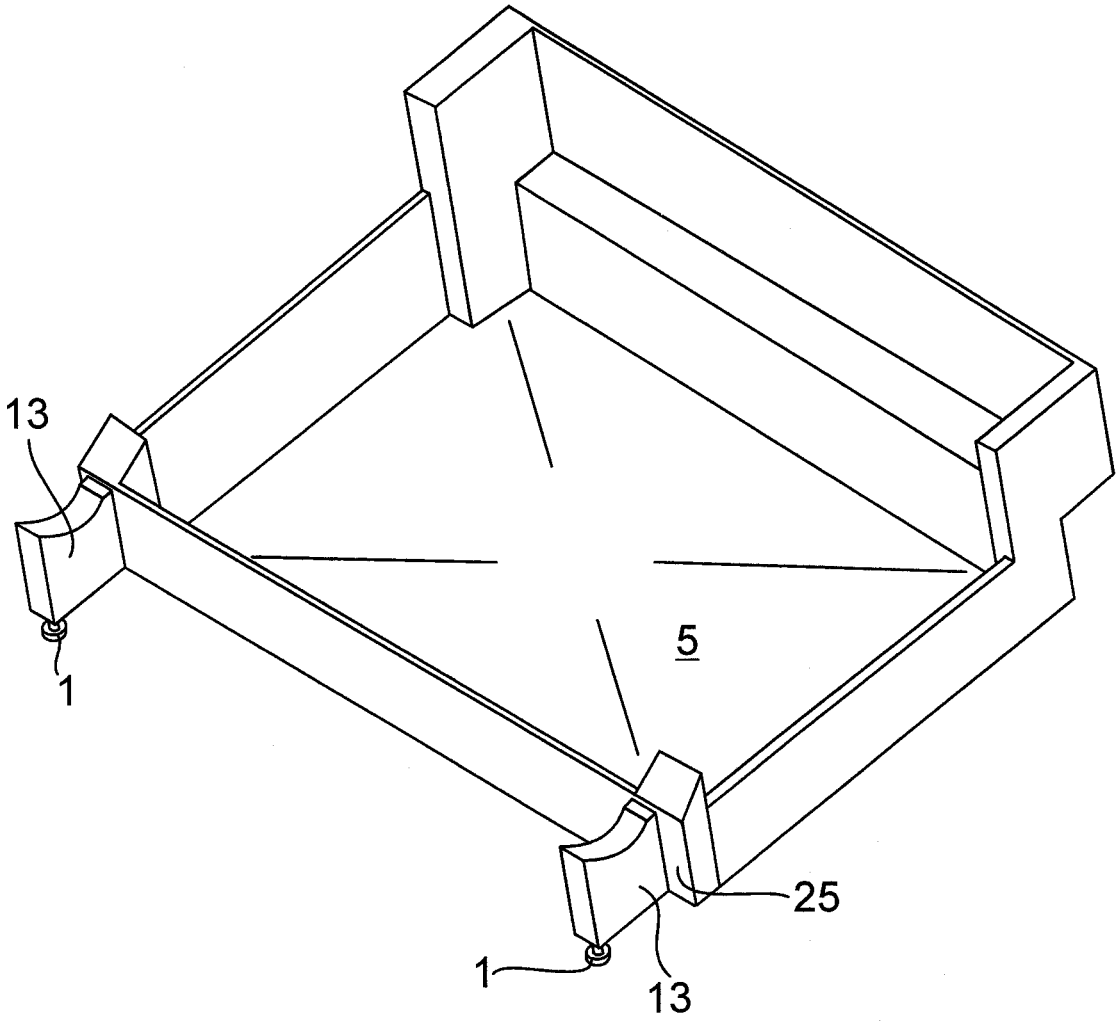
FIG. 2 is a perspective top view of a base support of a household appliance having a frontally joined appliance-foot support.

The appliance foot 1 that is shown in FIG. 1 having an assigned appliance-foot support 13 is provided structurally identically on both the left and the right at the front on the base support 5, as can be seen in FIG. 2.

The appliance-foot support 13 has as shown in FIG. 2 a threaded channel 15 in which the appliance foot 1 is height-adjustably ducted by means of its threaded shank. Both the base support 5 and the appliance-foot support 13 have been produced simply in production-engineering terms as plastic injection-molded parts. The appliance-foot support 13 can additionally support a frontal pedestal panel (not shown) that decoratively finishes the dishwasher downwardly. The pedestal panel can by way of example be pushed frontally onto the two appliance-foot supports 13.

Figure 3:
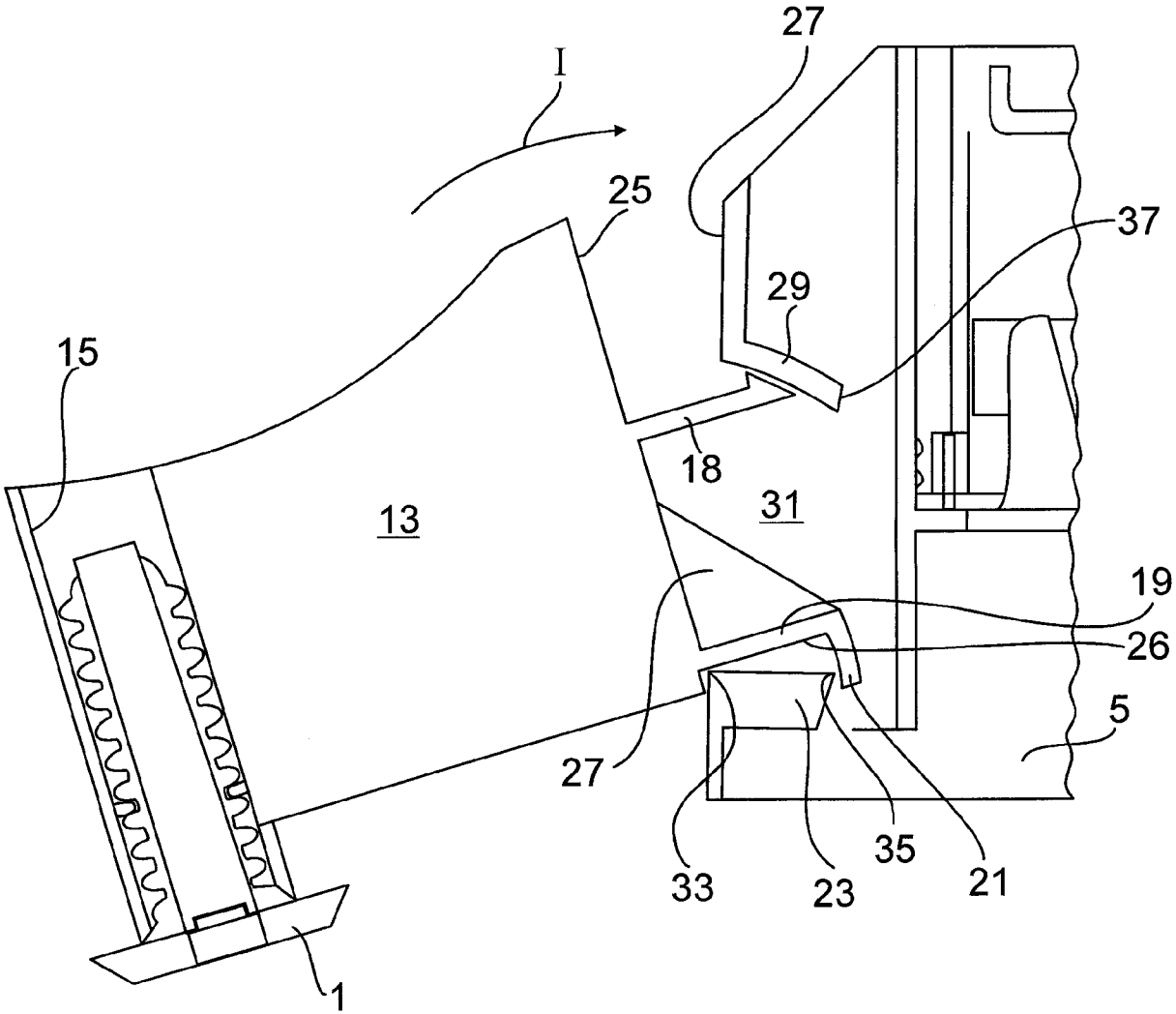
FIG. 3 shows the mounting of an appliance-foot support on the household appliance's base support.
Figure 4:
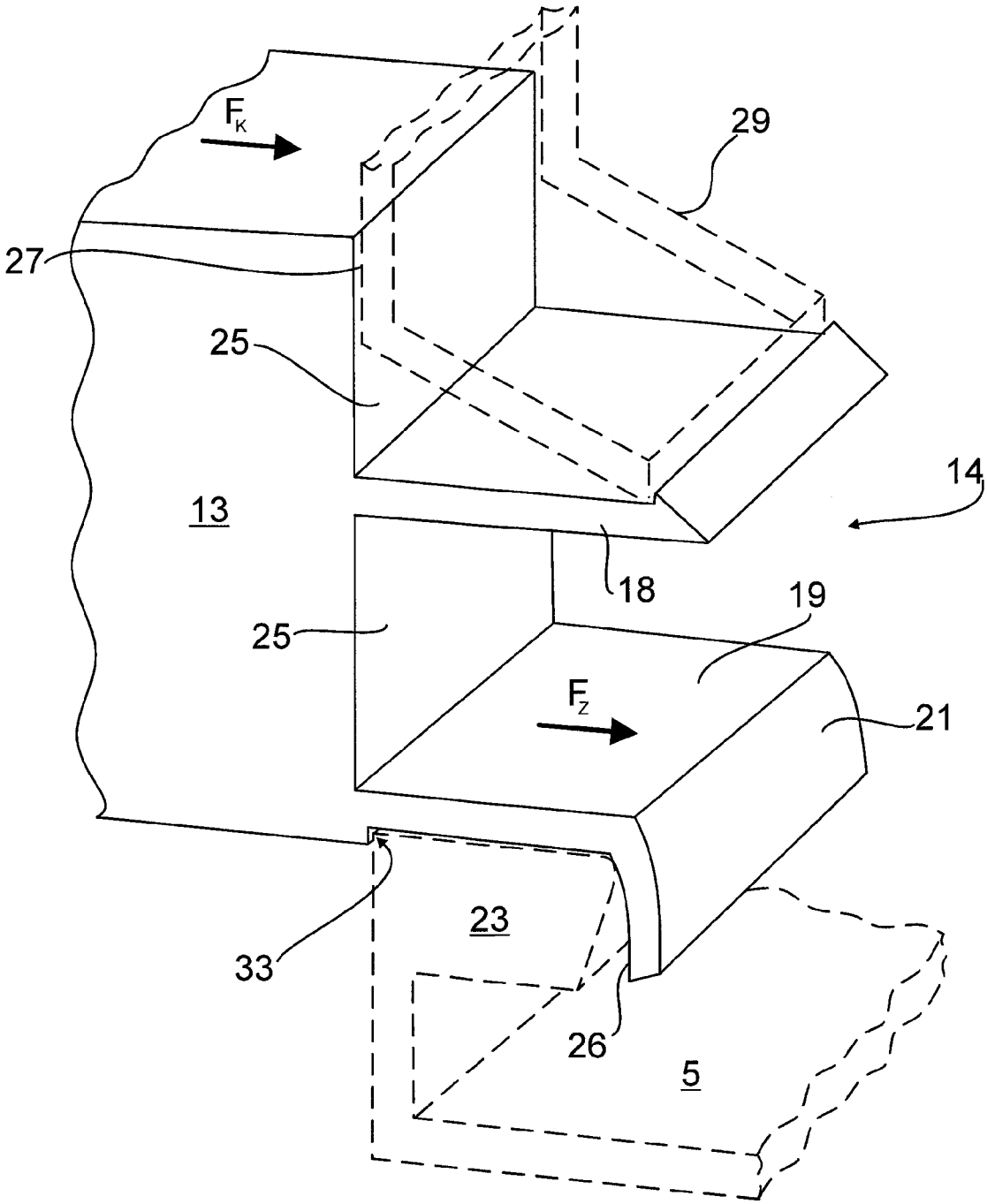
FIG. 4 is an enlarged partial perspective view of the join between the appliance-foot support and the household appliance's base support.

The above-described snap-in/clamping connector 14 between the appliance-foot support 13 and base support 5 has as shown in FIGS. 2 to 4 a catch hook 18 and, as a tensioning element, a tension lever 19. In the mounted condition as shown in FIGS. 1 and 4 the tension lever 19 engages by means of an angled limb 21 under the effect of a tensile force $F_Z$ around a backstop 23 molded onto the base support 5, as a result of which the appliance-foot support 13 will in a simple manner be braced firmly against the base support 5.

Together with its limb 21 and a vertical holding surface 25 of the appliance-foot support 13, the tension lever 19 forms a downwardly open U-shaped holding profile 26. The catch hook 18 and tension lever 19 therein project perpendicularly from the contact surface 25 of the appliance-foot support 13.

Owing to the acting tensile force $F_Z$, the backstop 23 is clamped or, as the case may be, fixed in the holding profile 26 between the contact surface 25 of the appliance-foot support 13 and the tension-lever limb 21. The tension lever 21 thereby braces the appliance-foot support 13 against the base support 5 in a manner free from play, as can otherwise be achieved only by means of a far more effort-intensive screw connection. With its contact surface 25, the appliance-foot support 13 is in the top region in wide-area contact with the contact surface 27 of the base support 5. The contact surface 27 of the base support 5 is therefore able to securely accommodate the tilting force $F_K$ of the appliance-foot support 13 due to the weight load G, as will be further described later.

With the dishwasher in its functioning position as shown in FIGS. 1 and 4 there is the following force distribution between the appliance-foot support 13 and base support 5: The base support 5 supports the appliance units (not shown) having a weight force G. The weight force G is transmitted via the forwardly projecting appliance-foot support 13 to the floor 7. Between the holding profile 26 of the respective appliance-foot support 13 and the backstop 23 of the base support 5 there is a "tilt axis" around which, owing to the weight load G, a tilting moment is produced which by means of the tilting force $F_K$ pushes the appliance-foot support 13 firmly against the contact surface 27 of the base support 5. The appliance-foot support 13 is therefore supported by means of the horizontally acting tilting force $F_K$ against the contact surface 27 of the base support 5.

Overall a stable join between the appliance-foot support 13 and base support 5 and hence a reliable force transmission to the appliance foot 1 of the appliance-foot support 13 is insured thereby in the functioning position as shown in FIGS. 1 and 4.

To insure that the tension lever 19 engages reliably with the backstop 23 during assembly, transverse bracing walls 27 are provided between the contact surface 25 of the appliance-foot support 13 and the tension lever 19 so that the tension lever 19 cannot execute an upward excursion.

In contrast to the tension lever 19 braced by means of the bracing walls 27, the catch hook 18 of the appliance-foot support 13 can be elastically displaced. According to the mounted position shown in FIG. 1, the catch hook 18 engages behind a side wall 29 of the base support 5, as a result of which the tension joint is secured and the appliance-foot support 13 is fixed in its position. Moreover, the catch hook 18 will not be subjected to any additional mechanical loads due to the weight force G.

Together with the backstop 23, the side wall 29 of the base support 5 forms a horizontally forwardly open insertion shaft 31 into which the catch hook 18 and tension lever 19 project.

For mounting the appliance-foot support 13 onto the base support 5, as shown in FIG. 3 the catch hook 18 and tension lever 19 are swiveled into the insertion shaft 31 of the base support 5 through a swiveling motion I. To achieve a guided swiveling motion I, as shown in FIG. 2 an angular segment of the U-shaped holding profile 26 of the appliance-foot support 13 can be positioned against a bottom contact edge 33 of the insertion shaft 31. The contact edge 33 serves thereby as a swivel axis for the swiveling motion I. The limb 21 of the tension lever 19 is swiveled downward during the swiveling motion I along a contact edge 35, located in the insertion shaft 31, of the backstop 23 with increasing tensile force $F_Z$ until the tension lever 19 is located in its mounted condition on the backstop 23 and the catch hook 18 engages in its locking position behind the side wall 29.

Provided in the side wall 29 is an access opening 37. To detach the appliance-foot support 13 for customer-service purposes, through the access opening 37 a tool can move the catch hook 18 from its locking position to an unlocking position. In the unlocking position of the catch hook 18 the appliance-foot support 13 can be swiveled counter to the swiveling motion 1 out of the insertion shaft 31.

The invention claimed is:

1. A household appliance, comprising:

a base support on which appliance devices are mounted and which is supported on a floor via one or more appliance feet;

an appliance-foot support that supports an appliance foot of the one or more appliance feet, the appliance-foot support being joined to the base support and extending laterally away from the base support; and a tension lever mounted to the appliance-foot support, wherein the tension lever is configured for engagement with the base support upon at least one of tilting and swiveling the appliance foot support to direct the tension lever into an insertion opening of the base support to facilitate supporting at least a portion of the appliance by the appliance foot, wherein the tension lever includes an angled limb structured to engage behind a backstop on the base support under an effect of a tensile force, the backstop being configured for receipt in a downwardly open holding profile formed by the angled limb of the tension lever.

2. The household appliance as claimed in claim 1, wherein the tension lever is structured to push the appliance-foot support against the base support with at least one of a clamping force and a tensile force.

3. The household appliance as claimed in claim 1, wherein the tension lever is joined to the appliance-foot support in at least one of a materially integral manner and a single piece therewith.

4. The household appliance as claimed in claim 1, wherein the backstop of the base support is at least one of fixed and clamped between the appliance-foot support and the angled limb of the tension lever under the effect of the tensile force.

5. The household appliance as claimed in claim 4, wherein the appliance-foot support together with the tension lever are structured to form a U-shaped, open holding profile, which when the tensile force is established, engages around the backstop.

6. The household appliance as claimed in claim 5, wherein the tension lever is structured to engage with the backstop in at least one of a tilting motion and a swiveling motion during which the angled limb of the tension lever is structured to be swiveled along a contact edge of the backstop onto the backstop as the tensile force is established.

7. The household appliance as claimed in claim 6, wherein the appliance-foot support is positioned against the contact edge of the backstop for embodying a swivel axis.

8. The household appliance as claimed in claim 5, wherein the tension lever includes at least one bracing element.

9. The household appliance as claimed in claim 5, wherein the tension lever includes a snap-in connector securing a mounting position of the appliance-foot support.

10. The household appliance as claimed in claim 9, wherein at least one of the tension lever and a catch hook of the snap-in connector project in a mounted condition into an insertion shaft of the base support.

11. A household appliance, comprising:

a base support on which appliance devices are mounted and which is supported on a floor via one or more appliance feet;

an appliance-foot support that supports an appliance foot of the one or more appliance feet, the appliance-foot support being joined to the base support and extending laterally away from the base support; and a tension lever mounted to the appliance-foot support, wherein the tension lever includes a snap-in connector securing a mounting position of the appliance-foot support, wherein at least one of the tension lever and a catch hook of the snap-in connector project in a mounted condition into an insertion shaft of the base support, and wherein the tension lever is configured for engagement with the base support upon at least one of tilting and swiveling the appliance foot support to direct the tension lever into an insertion opening of the base support to facilitate supporting at least a portion of the appliance by the appliance foot.

* * * * *